United States Patent [19]

Schuler

[11] 4,129,146

[45] Dec. 12, 1978

[54] LIQUEFIED GAS TANK AND METHOD OF FILLING

[75] Inventor: Alan L. Schuler, Hingham, Mass.

[73] Assignee: General Dynamics Corporation, St. Louis, Mo.

[21] Appl. No.: 796,550

[22] Filed: May 13, 1977

[51] Int. Cl.[2] ..... F17C 5/02

[52] U.S. Cl. ..... 137/587; 62/45; 62/55; 137/592; 220/455; 220/465; 220/901

[58] Field of Search ..... 220/9 LG, 14, 373, 455, 220/456, 901, 465; 114/74 A; 62/55, 45, 47, 48; 137/587, 592; 141/325

[56] References Cited

U.S. PATENT DOCUMENTS

| | | | |
|---|---|---|---|
| 1,478,479 | 12/1923 | Lackmann | 62/55 |
| 1,865,319 | 6/1932 | Jensen | 220/373 |
| 2,290,038 | 7/1942 | Folmsbee | 114/74 A |
| 2,986,011 | 5/1961 | Murphy | 62/55 |
| 3,180,376 | 4/1965 | Sanborn | 220/86 R |
| 3,453,836 | 7/1969 | Kerr | 62/55 |
| 3,783,628 | 1/1974 | Reiche | 62/100 |

FOREIGN PATENT DOCUMENTS

| | | | |
|---|---|---|---|
| 642438 | 9/1950 | United Kingdom | 220/9 LG |
| 850244 | 10/1959 | United Kingdom | 220/9 LG |

*Primary Examiner*—William Price
*Assistant Examiner*—Allan N. Shoap
*Attorney, Agent, or Firm*—Fitch, Even, Tabin & Luedeka

[57] ABSTRACT

A liquefied gas tank having thermal insulation in association with a fluidtight body. A liquid supply line terminates at a location within the upper half of said vessel and discharges into a vertical draft-tube which is in fluid communication with the ullage portion of the vessel. The liquefied gas which is supplied into the draft-tube is conditioned to the pressure and temperature within the vessel as it travels downward to the bottom before it can flow radially outward into the tank.

11 Claims, 3 Drawing Figures

LIQUEFIED GAS TANK AND METHOD OF FILLING

This invention relates generally to filling tanks with liquefied gases having a normal boiling point of about 0° C. or below and more particularly to systems for filling large closed tanks with cryogenic liquids.

In order to transport natural gas from producing regions of the world to user regions across an ocean, it has become common to liquefy it so as to greatly reduce its volume by appropriately lowering the temperature at its normal boiling point of atmospheric pressure, and as a result, transportation in ships or barges becomes economical. Liquefied natural gas (LNG), although consisting largely of methane, which has a boiling point of about −260° F. (−161° C.) includes minor amounts of other liquefied gases as part of a mixture. Although the present economic concern is centered upon the transportation of LNG, the considerations associated with the handling and transportation of large quantities of liquefied gases are equally applicable to liquefied gases such as ammonia, ethylene, propane, butane and chlorine.

It is presently recognized that a problem of avoiding thermal roll-over exists when filling large closed tanks with cryogenic liquid. Thermal roll-over results from a situation where the density of the liquefied gas being pumped into the tank is sufficiently different from the density of the liquefied gas already in the tank that it has the natural tendency to cause a certain pattern of movement within the body of liquid. For example, if the liquid being supplied is slightly warmer so that its density is less than the density of the body of liquid already within the tank and filling takes place from the bottom of the tank, the lighter liquid will have a tendency to rise to the top without the occurrence of substantial mixing and thus has the potential to cause disruption or imbalance of the body of liquid which was otherwise generally at rest within the tank. A similar potential would exist if colder liquid were supplied to the upper surface of a warmer liquid body. In large closed tanks, liquefied gases have the tendency to stratify so that a separate slug or region of warmer liquid can become trapped below the cooler, denser liquid— being held in this location as a result of the higher pressure environment in the lower part of the tank which is produced by the liquid head. When such a warmer slug or stratum is released, it may rapidly rise to the top with the colder upper stratum simultaneously sinking in a manner resembling a vortex, which is referred to as thermal roll-over.

This phenomenon of thermal roll-over is undesirable because it will be accompanied by a rapid evolution of a large quantity of vapor which, because of the amount generated in a very short time, cannot be practically handled by vapor recovery equipment. In order to avoid subjecting the tank to pressure above that for which it was designed, which could cause cracking or rupture, it is necessary to quickly relieve the pressure by venting to the atmosphere. This not only results in loss of the product, but may also pose a potential hazard, e.g., because of the combustible nature of LNG or the like.

Previous attempts have been made to combat this problem by providing a valving system whereby liquid being supplied can be discharged either into the top of the tank or into the bottom of the tank. Assuming there is no equipment available to constantly monitor the conditions within the tank, an operator makes an educated guess as to whether to employ a top or bottom fill to reduce the possibility of thermal roll-over within the tank.

The present invention eliminates the need for either guesswork or conrol because it minimizes the potential for thermal roll-over within a liquefied gas tank regardless of whether the density of the liquid already in the tank is greater or less than the density of the liquid being supplied. An arrangement is employed by which the liquid being supplied is acclimated to the conditions within the tank prior to its mixing with the main body of liquid and, as a result, effects a relatively tranquil filling of liquefied gas into large closed tanks.

Various of the features of the invention will be apparent from the following detailed description of a preferred embodiment of a cryogenic tank arrangement, particularly when read with reference to the accompanying drawings wherein.

Figure 1:
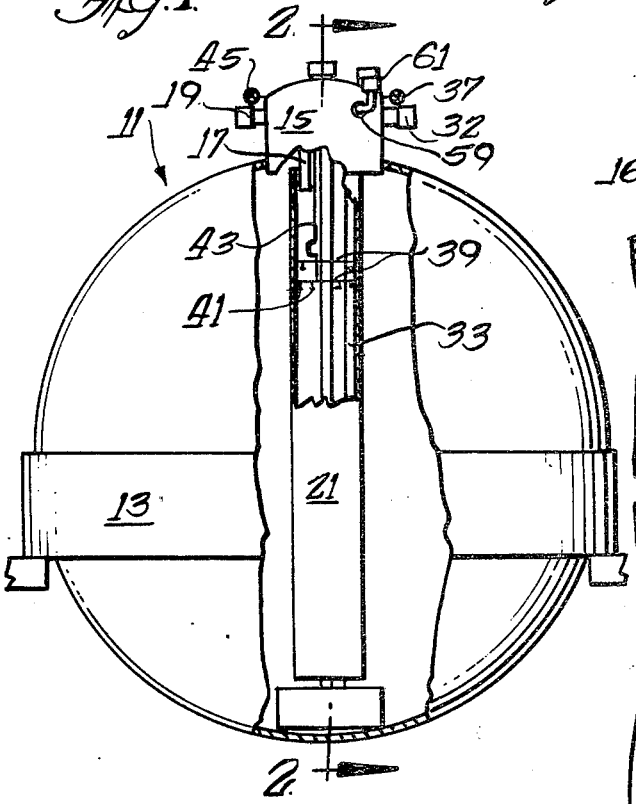
FIG. 1 is a side elevation view, with portions broken away, of a spherical tank arrangement embodying various features of the invention.
Figure 2:
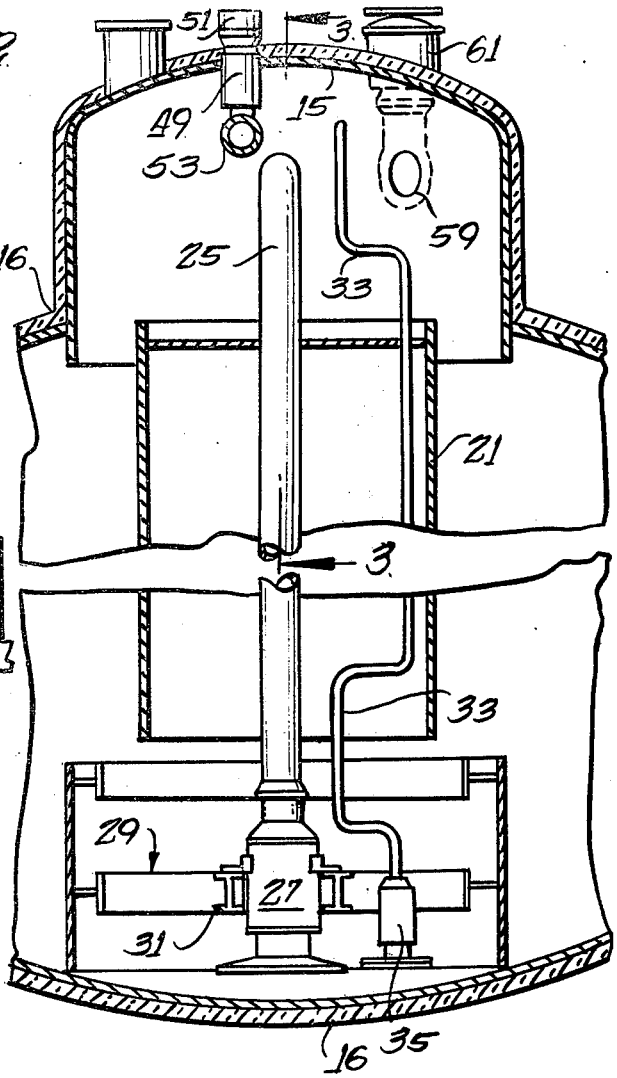
FIG. 2 is an enlarged sectional view of the tank shown in FIG. 1 taken generally along the line 2—2 of FIG. 1.
Figure 3:
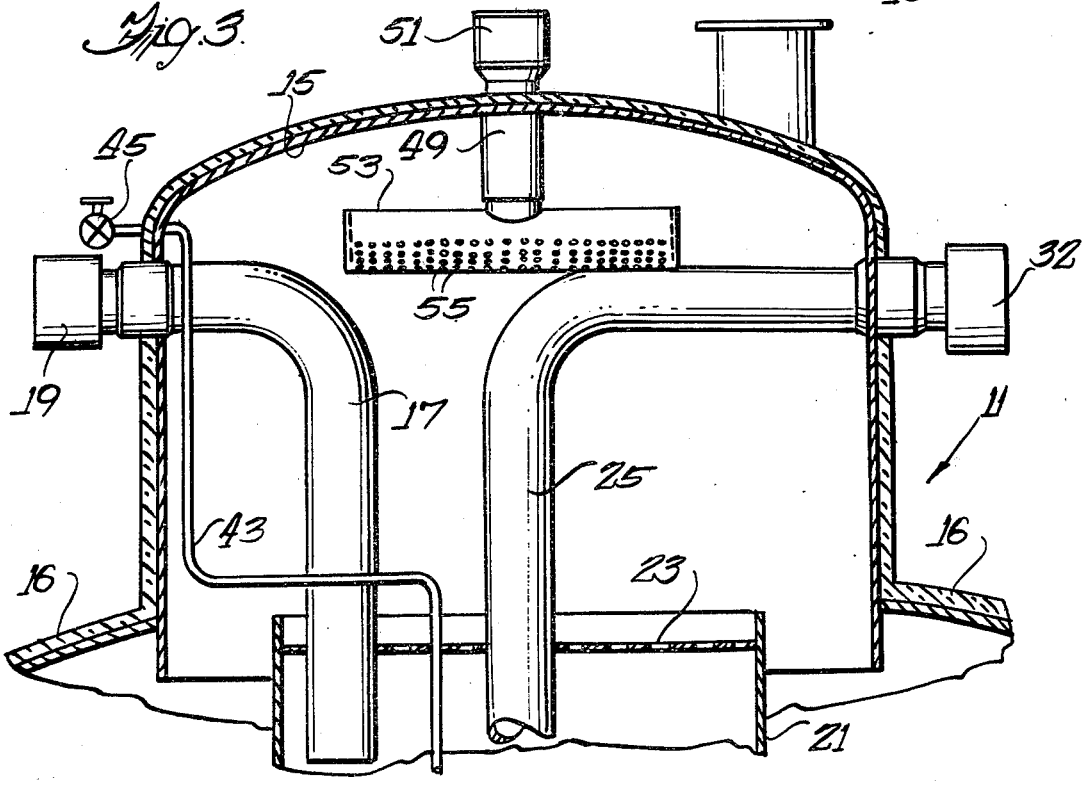
FIG. 3 is a further enlarged sectional view generally taken along line 3—3 of FIG. 2.

Illustrated in the drawings is a large spherical tank 11 of the type designed to be a part of an LNG transport ship of the general type, for example, as that shown in U.S. Pat. No. 3,680,323 issued Aug. 1, 1972. Such a tank may, for example, have a diameter of 120 feet and be designed to hold about 25,000 cubic meters of a cryogenic liquid such as liquefied natural gas (LNG). The tank 11 is designed to be affixed in the hull of the ship via a surrounding support ring or skirt 13 which is integral with the tank at about its equator. The tank 11 includes a generally spherical metal vessel, made for example of aluminum plate that may vary in thickness from about 1⅜ in. to 7 in., which is surmounted by a generally cylindrical dome 15.

The metallic vessel and the dome are thermally insulated by a suitable insulating material 16, for example, multiple layers of polyurethane foam. With respect to the illustrated tank, the thermal insulation 16 is disposed exterior of the metallic walls; however, there are proposals to locate thermal insulation within a metal tank and include a liquid-and vapor-tight membrane on the inner surface of the insulation to prevent leakage of the cargo liquid into the insulation.

An LNG supply line 17 penetrates the tank wall near the upper end of the dome 15 and contains a connector 19 at the outer end thereof for interconnection with the cargo piping system aboard the ship. The supply line contains a 90° bend and continues downward vertically below the level of the dome where it terminates at a point about 57 feet above the equator of the sphere. Disposed vertically within the vessel on the center line thereof is a large hollow tower or draft tube 21 which may be about 8.5 feet in diameter. As illustrated, the lower end of the liquid fill pipe 17 extends about a foot below the upper end of the draft tube 21 so that the LNG being supplied discharges into the upper end of the draft tube, so that it must therefore flow vertically downward throughout the length of the draft tube before it can mix with the LNG already in the tank 11.

The upper end of the draft tube 21 is functionally open and in fluid communication with the ullage within the top of the tank 11; however, a perforated baffle plate 23 is provided for a purpose discussed hereinafter. The bottom of the draft tube 21 is suitably supported by structural connections (not shown) to the metal vessel, and it extends to a distance of about 7 feet from the bottom of the tank. Preferably, the remainder of the piping is disposed within and supported from the draft tube 21, thus leaving the region between the outer surface of the draft tube and the inner surface of the spherical tank completely free and available to hold LNG.

To remove the LNG from the tank 11, a central discharge pipe 25 is located coaxially within the draft tube 21, or at some other suitable location therein. Affixed to the lower end of the discharge pipe 25 is a submersible pump 27 which is driven by an electric motor. In order to accommodate the thermal contraction of the piping, which will occur when the temperature is reduced from ambient to cryogenic temperatures, a sliding support arrangement 29 is provided for the submersible pump in a base that is appropriately affixed to the bottom of the spherical vessel and which includes vertical guideways 31. This sliding arrangement allows free movement of the pump 27 in a vertical direction as the temperature falls and the discharge pipe 25 thermally contracts. The upper end of the discharge pipe 25 turns at 90° and exits through the wall of the dome 15 to a coupling 32 which connects to a cargo pipe discharge network extending throughout the ship.

Also disposed within the draft tube 21 is a first piping arrangement 33 which connects to a smaller submerged pump 35 which is supported from the base 29. This piping arrangement 33 may be about 1½ inches in diameter and includes a number of bends so that the inherent flexibility of the pipe is relied upon to accommodate thermal expansion and contraction. This piping arrangement 33 exits through the dome wall and terminates in a valve 37 which connects to a spray piping system (not shown). Two headers 39 are supported within the draft tube 21 and carry spray nozzles 41 that are positioned at the outer surface of the draft tube 21 at a location about half-way between the equator and the top of the tank. The headers 39 are connected to a second piping arrangement 43 which extends upward through the dome wall to a valve 45 that likewise connects to the spray piping system of the ship. Accordingly, the small pump 35 in any tank can be used to pump LNG from the bottom of that tank upward through the piping arrangement 33 and then back down and out the spray nozzles 41 to effect a more rapid cool-down of that tank prior to complete filling with LNG, or alternatively during ballast voyage in order to desirably maintain the desired low temperature environment therewithin. Because each pump 35 is coupled through the spray piping system to the piping arrangements 43 of the other tanks in the ship, a single pump 35 can be used to spray LNG from the bottom of one tank into several of the relatively empty cargo tanks during ballast voyage.

Provision is also made in the ship's cargo piping network for the return of vapor from the tank to the facility from which the LNG is being supplied so that the vapor can be reliquefied. Accordingly, a vapor outlet 49 is provided from the tank 11 which passes through the upper surface of the dome 15 where a suitable coupling 51 is affixed for connection into the cargo piping network of the ship. The lower end of the vapor outlet 49 terminates in a short cross pipe 53 which is closed at both ends by suitable circular plates and which has a drilled hole pattern 55 filling the entire lower half thereof. This cross pipe inlet construction minimizes the amount of entrained LNG that might be carried with the vapor being removed from the tank because such entrained liquid will tend to form droplets on the perforated surface and drip downward in the draft tube 21.

From a safety standpoint, another outlet pipe 59 is provided which penetrates through an upper location in the side wall of the dome 15 and connects to a relief valve 61. As earlier indicated, the tank 11 is not designed to operate at the high pressures which liquefied gases are of course capable of generating upon warning, and the relief valve 61 is set to open if the pressure within the tank reaches, for example, about 3 psig. (about 1.2 atm. absolute) so as to assure the tank pressure remains close to atmospheric pressure both during filling and discharge operations as well as during voyage. Should the relief valve open, the LNG vapor which escapes is vented through a conduit (not shown) up the mast of the ship so as to be discharged into the atmosphere at a location well above the main deck of the ship where it will dissipate into the atmosphere without endangering ship's personnel. Normally, of course, if the ship systems are operating in the intended manner, the relief valve pressure will not be reached.

Provision is made for maintaining the LNG within the tanks 11 in equilibrium at about the boiling point of the cargo, recognizing that there will be some influx of heat from the ambient atmosphere. For example, refrigeration equipment might be provided to counterbalance the inflow of heat into the tank. However, if heat influx is held to a minimum by an effective insulation system, some evaporation of LNG may be permitted, and the vapor outlet 49, the coupling 51 and cargo piping network are used to withdraw vapor from the tanks at a rate approximately equal to that at which it is being created by evaporation. Generally, vapor network is connected to the suction side of one or more compressors which are operated to maintain the vapor pressure within the tanks at about 1.8 psig., which is below the relief valve setting. The withdrawn natural gas is either burned as fuel in the ship's propulsion boilers or can be reliquefied through liquefaction equipment provided in the ship for ultimate return to the individual tanks.

Because the LNG supply pipe 17 terminates generally adjacent to the top of the draft tube 21, the entering LNG is thus immediately exposed to the pressure conditions within the tank, at a time well before it mixes with the LNG already in the tank. As a result, the interior region of the draft tube 21 serves as an expansion chamber into which the incoming LNG is discharged and wherein it thermally conditions itself to the vapor pressure of the cargo tank ullage. Moreover, inasmuch as the incoming LNG must flow all the way down the draft tube 21 before it can enter into the main portion of the spherical tank exterior of the draft tube and begin to mix with the LNG already present, there is ample time for the incoming LNG to reach thermal equilibrium. Accordingly, if the incoming LNG should be slightly warmer, evaporation can immediately take place, and the vapor created will travel upward in the draft tube, cooling the incoming LNG above it and being immediately available for withdrawl and return to the shore facility for reliquefaction. As the liquid slowly travels to the bottom of the draft tube 21, its density gradually changes, and as a result it has substantially the same density as the LNG at the bottom of the tank when it begins to flow outward from the bottom of the draft tube. Accordingly, the possibility of thermal roll-over is substantially eliminated, and instead a relatively tranquil or quiescent filling takes place where the incoming liquid remains at or near the bottom of the tank and simply upwardly displaces the liquid already in the tank.

In order to accomplish this desirable objective, it is believed that the incoming LNG should enter an expansion chamber at a location within the upper vertical one-quarter of the tank and preferably at a location which is within the upper 10 percent of the height of the tank. Accordingly when a draft tube 21 is used to provide the expansion chamber arrangement, it should extend upward to a level at least about equal to the discharge point of the supply pipe 17, which pipe should terminate at a vertical level within the upper half of the tank, so that there is time for expansion and thermal stabilization to take place before mixing occurs. Similarly, the draft tube 21 should extend downward to a distance to within the bottom one-quarter of the vertical height of the tank and preferably to a distance from the tank bottom equal to not more than about 10 percent of the height of the vessel.

In the illustrated arrangement, the supply pipe 17 has a substantially constant internal diameter of about 14 inches, and it discharges into a draft tube 21 having an interior diameter of about 8.5 feet. Accordingly, the area of the draft tube 21 is more than 50 times the area of the supply pipe 17 so that there is no restraint upon the LNG upon its discharge from the supply pipe. To accomplish the desired objective, the area of the expansion chamber region should be at least about 10 times the area of the supply pipe, and preferably more than 20 times its area.

Because the open top of the draft tube 21 is in fluid communication with the vapor in the ullage of the tank 11, the falling stream of LNG is intimately exposed to the pressure conditions within the tank. In addition, the fact that the column of LNG within the draft tube 21 takes some finite time to travel downward to the bottom where it can flow outwardly into the reservoir of LNG already within the tank, provides ample opportunity for thermal equalization to occur. As a result the density of the incoming LNG at the bottom of the column will quite closely match the density of the LNG in the reservoir so that undesirable circulation patterns will not be generated. Once a year it is anticipated it may be necessary to evacuate the tank to permit its physical inspection from inside, and it is intended that all LNG within the tank will be vaporized by the introduction of warm natural gas, either through the fill pipe 19 or the vapor pipe 51 and removed through the other. So as not to short-circuit the path between these pipes through the bottom of the draft-tube 21, the perforated plate 23 is provided having a plurality of holes having a total area equal to about that of a 6-inch diameter opening.

Although the invention has been described with regard to the preferred embodiment illustrated in the drawings, it should be understood that changes or modifications may be made as would be obvious to one having the ordinary skill in this art without departing from the scope of the invention which is defined solely by the appended claims. In this respect, instead of freely discharging the LNG into a larger diameter vertical tube, the supply line could be extended downward and equipped with an expansion chamber arrangement which would, although continuing to confine the LNG physically, subject it to the pressure conditions within the vessel, as through a bellows or other type of pressure compensating device and/or the use of a piping arrangement to such an expansion chamber which would be in fluid communication with the ullage portion of the tank. With the addition of such an expansion chamber arrangement, the fill pipe itself might then be extended to a location near the bottom of the tank so that, following pressure compensation within the upper portion of the vessel, thermal stabilization could take place as a result of heat transfer across the fill pipe itself as the incoming liquid travels downward through the liquid reservoir which surrounds it in the vessel.

Likewise, although the discussion has been centered upon the shipment of LNG, there are other cryogenic liquids which are shipped in sufficiently large quantities by liquefaction and maintenance under low temperatures to justify treatment in this manner. For example, it is contemplated that this type of fill arrangement would be particularly advantageous for the shipment of liquefied gases having a normal boiling point about equal to that of ammonia or lower, which for purposes of this application are generally considered to be cryogenic liquids. Moreover, the reference to large closed tanks is considered to mean tanks capable of containing at least about 5,000 cubic meters of liquid.

Various of the features of the invention are set forth in the claims which follow.

What is claimed is:

1. A tank for holding liquefied gas designed for filling without problem of thermal roll-over, which tank comprises a fluidtight body which defines a liquid storage vessel, thermal insulation means in association with said body to provide a thermal barrier between the low temperature environment inside said vessel and ambient, a liquid supply line into said vessel for filling said vessel with liquefied gas and terminating at a location within the upper half of said vessel, means for connecting said supply line to a source of liquefied gas, draft-tube means within said vessel extending generally vertically from a location within the upper-quarter thereof to a location within the lower-quarter thereof, discharge pipe means in addition to the supply line for emptying liquefied gas and extending from a location near the bottom of said vessel, said supply line being located so as to discharge the liquefied gas being supplied within the confines of said draft-tube, said draft tube having a cross sectional area at least about ten times the cross sectional area of supply line, and the upper end of said draft-tube being in fluid communication with the ullage portion of said vessel and the lower end of said draft-tube being in liquid communication with said liquid-holding portion of said vessel whereby the possibility of thermal roll-over during filling is substantially eliminated.

2. A tank in accordance with claim 1 wherein a vapor line is provided which extends through said fluid-tight body and which is in communication with the ullage portion of said vessel.

3. A tank in accordance with claim 2 wherein said vapor line has a horizontal entry tube having an imperforate upper half and a plurality of holes not greater than about ½ inch in diameter in its lower half.

4. A tank in accordance with claim 1 wherein the cross sectional area of said draft tube is at least about 20 times the cross sectional area of said supply line at said discharge location.

5. A tank in accordance with claim 1 wherein said discharge location is at a height within the upper 10 percent of the vertical height of said vessel.

6. A tank in accordance with claim 1 wherein the lower end of said draft tube is spaced from the bottom of said vessel by a distance of about 10 percent or less of the vertical height of said vessel.

7. A tank in accordance with claim 1 wherein said liquid discharge pipe means extends upward through said draft-tube and exits from said vessel at an upper location, said discharge pipe means being connected to a submerged pump at its lower end.

8. A tank for holding liquefied gas designed for filling without problem of thermal roll-over, which tank comprises a substantially spherical fluid-tight body which defines a vessel for storing liquefied gas, thermal insulation means in association with said spherical vessel wall which provides a thermal barrier between the low temperature environment therewithin and ambient temperature outside the vessel, cylindrical draft tube means supported within said vessel body and connected thereto which extends vertically from a location within the upper one-quarter of the spherical cavity to a terminus within the lower one-quarter thereof, a liquefied gas supply line extending into said vessel for filling said vessel with liquefied gas and terminating at a location within the upper one half of said vessel in vertical alignment with the cylindrical cavity of the draft tube so as to discharge liquefied gas being supplied within the confines of said draft tube, said draft tube having a cross sectional area at least about ten times the cross sectional area of said supply line, means for connecting said supply line to a source of liquefied gas, and discharge pipe menas in addition to said supply line which extends from a location near the bottom of said vessel for emptying liquefied gas from said vessel the upper end of said draft-tube being in fluid communication with the ullage portion of said vessel and the lower end of said draft-tube being in liquid communication with the liquid-holding portion of said vessel whereby the possibility of thermal roll-over during filling is substantially eliminated.

9. A tank in accordance with claim 8 wherein said draft tube has a cross sectional area at least about 20 times the cross sectional area of the supply line.

10. A tank in accordance with claim 9 wherein the bottom of said draft tube is spaced from the bottom of said vessel a distance not more than about ten percent of the height of the vessel.

11. A tank in accordance with claim 8 wherein a vapor outlet line extends into said vessel and is located in the upper portion thereof, which vapor line includes an entrance chamber having an imperforate upper wall portion and a perforated underside, through which perforations vapor can exit said vessel during filling.

* * * * *

UNITED STATES PATENT AND TRADEMARK OFFICE

CERTIFICATE OF CORRECTION

PATENT NO. : 4,129,146

DATED : December 12, 1978

INVENTOR(S) : Alan L. Schuler

It is certified that error appears in the above–identified patent and that said Letters Patent are hereby corrected as shown below:

Column 4, line 2, after "plates"

insert --to form an entrance chamber--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*